US005775432A

United States Patent [19]

Burns et al.

[11] Patent Number: 5,775,432

[45] Date of Patent: Jul. 7, 1998

[54] FRONT SQUEEZE TRIGGER HANDLE FOR USE WITH FIRE EXTINGUISHERS

[75] Inventors: Clay Burns, Boston, Mass.; Victor Cheung, Chicago, Ill.; Paul Sabin, Milton, Mass.; Susannah Gardner, Berkeley, Calif.

[73] Assignee: BRK Brands, Inc., Aurora, Ill.

[21] Appl. No.: 596,941

[22] Filed: Feb. 5, 1996

[51] Int. Cl.[6] ..... A62C 13/76

[52] U.S. Cl. ..... 169/74; 239/333; 239/436

[58] Field of Search ..... 169/74, 88; 239/333, 239/337, 391, 436

[56] References Cited

U.S. PATENT DOCUMENTS

| | | | |
|---|---|---|---|
| Re. 22,045 | 3/1942 | Towart | 169/74 |
| 2,681,707 | 6/1954 | Mapes | 169/74 |
| 3,254,807 | 6/1966 | Boch et al. | 169/74 |
| 4,247,048 | 1/1981 | Hayes | 239/333 |
| 4,350,298 | 9/1982 | Tada | 239/333 |
| 4,619,328 | 10/1986 | Seyler et al. | 169/74 |

FOREIGN PATENT DOCUMENTS

| | | | |
|---|---|---|---|
| 1434924 | 10/1968 | Germany | 169/74 |
| 2129730 | 12/1971 | Germany | 169/88 |
| 2630519 | 1/1978 | Germany | 169/74 |
| 612363 | 7/1979 | Switzerland | 239/337 |
| 1466761 | 3/1989 | U.S.S.R. | 169/71 |
| 392433 | 5/1933 | United Kingdom . | |
| 439218 | 12/1935 | United Kingdom . | |
| 524474 | 8/1940 | United Kingdom . | |
| 731228 | 6/1955 | United Kingdom | 239/391 |
| 977280 | 12/1964 | United Kingdom | 169/74 |
| 1 363 941 | 8/1974 | United Kingdom . | |
| 1 588 302 | 4/1981 | United Kingdom . | |

OTHER PUBLICATIONS

BRK Electronics product catalog CM759, p. 14, 1994.

BRK Brands product catalog CM760, pp. 6–7, 1995.

Pittway Corporation product catalog CM501, 3 pages, 1990.

*Primary Examiner*—Gary C. Hoge

*Attorney, Agent, or Firm*—Dressler, Rockey, Milnamow & Katz, Ltd.

[57] ABSTRACT

A front squeeze trigger discharge assembly for use with a fire extinguisher having a pressurized extinguishing medium therein includes a housing defining a flow chamber. The housing has a front portion and a rear portion configured to rest in the hand of a user, and a pivotable trigger handle mounted to the housing and positioned at the front portion thereof. The pivotable trigger handle is configured for gripping by a user's fingers. The handle includes a pivot for rotating the handle relative to the housing between a first position and a second position toward the housing for discharging the extinguishing medium from the extinguisher. The handle includes a discharge nozzle positioned on the front of the housing and a discharge valve assembly operably connected to said trigger handle for providing a flow path between the container and the discharge nozzle. The trigger handle is pivotable from the first position to the discharge position inward of the housing by gripping the handle and pulling thereon, i.e., squeezing the handle, moving the discharge valve assembly to the discharge position. The housing also includes a nozzle stem which is adapted to interchangeably receive one of a plurality of different discharge nozzles to permit use of the assembly with different types and sizes of fire extinguishers containing different types of extinguishing media, stored at various pressures.

27 Claims, 3 Drawing Sheets

FRONT SQUEEZE TRIGGER HANDLE FOR USE WITH FIRE EXTINGUISHERS

FIELD OF THE INVENTION

This invention pertains to a fire extinguisher trigger handle and more particularly to an extinguisher valve assembly with a front squeeze trigger handle. The assembly can be fitted with one of a plurality of different discharge nozzles for use with different size extinguisher bottles having different extinguishing media under differing pressures.

BACKGROUND OF THE INVENTION

Fire extinguishers are prevalent in commercial and residential settings alike. Known fire extinguishers are available in an array of sizes and shapes for commercial and residential use, and may be designed for extinguishing specific types of fires, such as class A, class B and class C fires.

Fire extinguishers which are available for residential or home use typically include a relatively small extinguisher bottle and a discharge handle, specifically designed for the extinguisher bottle. The discharge handle may have a thumb-type actuator, a rear-squeeze handle actuator or a bottom-squeeze handle actuator. The handle is mounted directly to the extinguisher bottle, and the contents of the extinguisher bottle are discharged directly from the bottle through the handle. Because of the relatively small size of home fire extinguishers, retaining control of the extinguisher while it is being used is not generally difficult.

In the thumb-type actuated extinguisher, a user grips the handle and presses a button or discharge switch located on the top of the handle with the user's thumb to discharge the contents of the extinguisher. In the rear-squeeze handle type actuator, the triggering or release mechanism is located at the rear of the handle and requires the user to apply pressure to the rear of the handle, generally with the palm of the hand, while maintaining control of the extinguisher bottle and aiming the extinguisher. Similarly, in the bottom-squeeze handle type of extinguisher actuator, the user must apply pressure upward, generally with the fingers, on the release mechanism while maintaining control of the extinguisher.

Known commercial types of extinguishers are similar to the residential types of extinguishers. The extinguisher handle is mounted directly to the bottle, with the discharge nozzle located on the handle. Other known types of commercial extinguishers include a flexible hose mounted to the handle so that the discharge from the bottle can be more readily directed at the fire.

Generally, any discharge type bottle, such as a fire extinguisher, may be unwieldy to handle while discharging, and may be difficult to aim. In addition, many such extinguisher discharge assemblies must be specifically designed for the particular extinguisher type and pressure, that is, the discharge assemblies may be specifically designed for the size of the bottle, the type of extinguishing medium and the pressure under which the extinguishing medium is maintained.

Thus, there continues to be a need for a fire extinguisher having a discharge assembly and handle which provides maximum control and directability, i.e., aim of the extinguisher while in use. Preferably such an assembly would readily permit use of the extinguisher with various types of extinguishing media at differing pressures.

SUMMARY OF THE INVENTION

A front squeeze valve assembly for use with an associated fire extinguisher having a pressurized medium therein includes a housing having a front portion and a rear portion configured to rest in the hand of a user. A trigger handle is pivotably mounted to the housing, positioned at the front portion thereof, and is configured for engagement by the user's fingers. The trigger handle pivots relative to the housing between a first, storage, position and a second position for discharge of the extinguishing medium.

The housing defines a flow chamber and includes a discharge nozzle positioned on the front of the housing. The flow chamber provides a flow path between the container and the discharge nozzle.

A discharge valve assembly is positioned within the flow chamber and is operably connected to the trigger handle. The valve assembly is actuated, i.e., moved into the discharge position, by squeezing the trigger handle toward the housing which, in turn, repositions the valve assembly to the open position to discharge the extinguishing medium. A nozzle stem extends from the flow chamber through the trigger handle and is adapted to interchangeably receive one of a plurality of different discharge nozzles.

Other features and advantages of the present invention will be apparent from the following detailed description, the accompanying drawings, and the appended claims.

DETAILED DESCRIPTION OF THE PREFERRED EMBODIMENTS

Figures 1, 2:
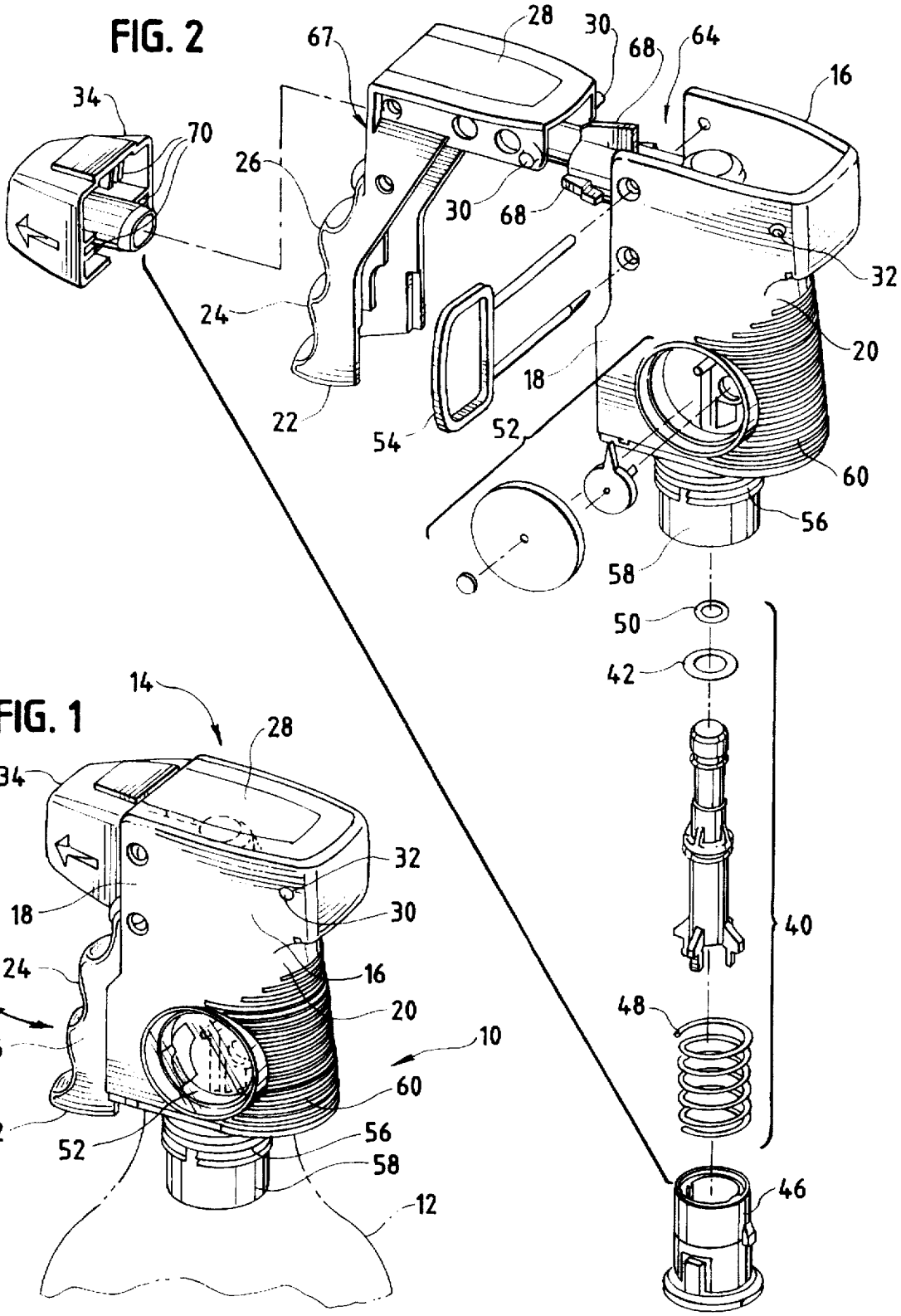
FIG. 1 is a perspective view of an extinguisher valve assembly having a front squeeze trigger, shown with a fire extinguisher bottle in phantom, in accordance with the principles of the present invention.
FIG. 2 is an exploded perspective view of the valve assembly of FIG. 1, illustrated with a safety release pin and an optional pressure dial-type gauge.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

FIG. 1 illustrates a fire extinguisher 10 including generally an extinguisher bottle 12, illustrated in phantom lines, and an assembly 14 with a front squeeze trigger. The bottle 12 is of a pressurized type for storing a pressurized fire extinguishing media.

It will be recognized by those skilled in the art that various types of extinguisher bottles may be used to store an array of extinguishing media such as foam, dry chemical, and the like, which media may be rated for extinguishing particular classes of fires. Extinguisher types are typically classified by hazard as: Class A, general purpose; Class B, flammable liquids; Class C, electrical fires; and Class D, combustible metals. All of the aforementioned extinguisher types, including others not presently contemplated, are within the scope of the present invention.

The assembly 14 which is best seen in FIG. 2, includes a housing 16 having a front portion 18 and a rear portion 20. The assembly 14 is configured to be gripped by a user, with the rear portion 20 resting in the palm of the user's hand.

The assembly 14 further includes a trigger portion 22 mounted to the housing 16 at the front portion 18 thereof. The trigger 22 is pivotably mounted to the housing 16 and is configured such that the extinguisher 10 is actuated by squeezing the trigger portion 22, or pulling inwardly on the trigger portion 22, toward the housing 16. In a preferred embodiment, the trigger 22 has a finger gripping formation 24 formed or molded into the body of the trigger portion 22 to facilitate gripping and controlling the extinguisher 10 when in use.

Figure 4:
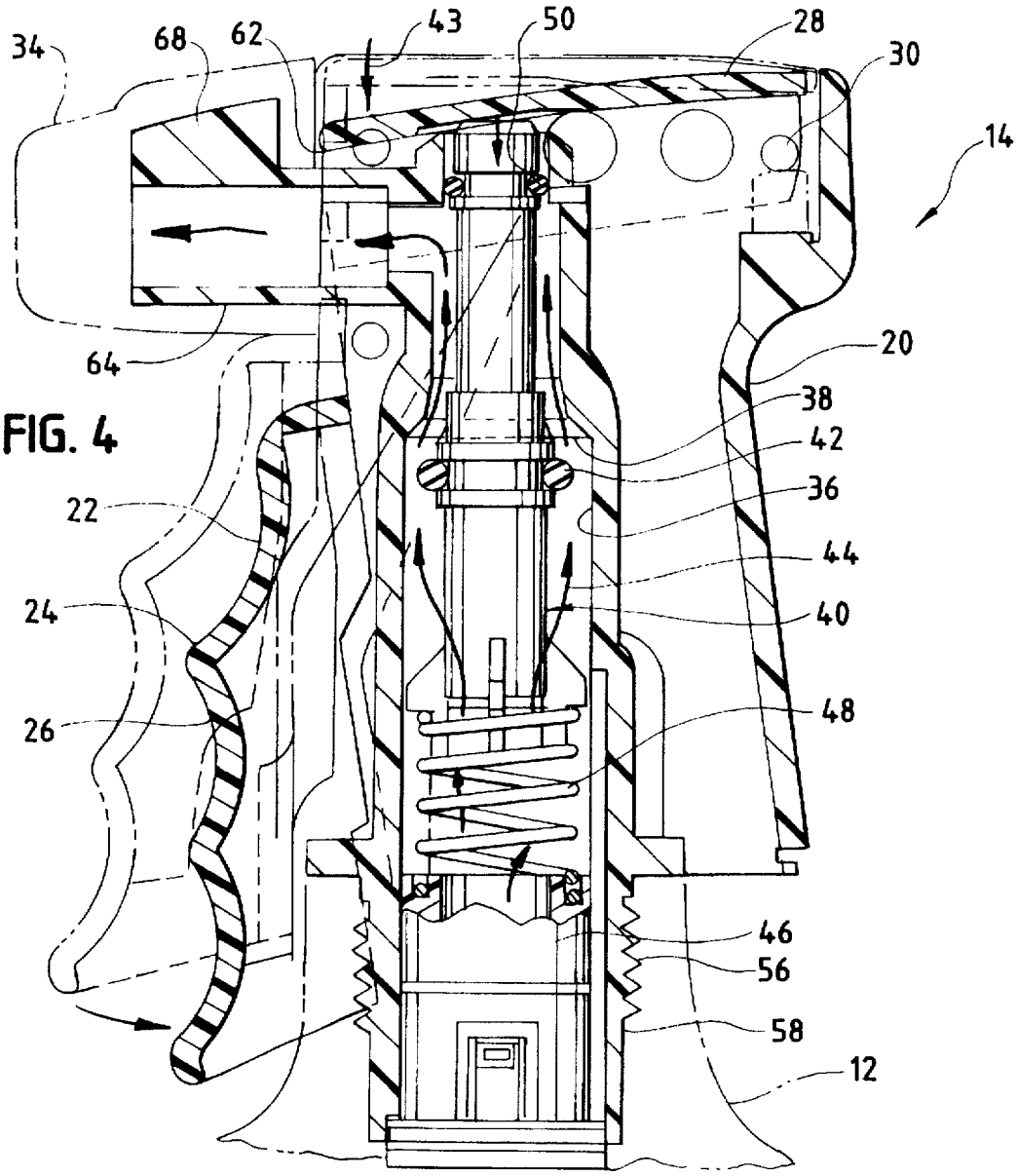
FIG. 4 is a side view, in partial cross-section, taken along line 4—4 of FIG. 3, illustrating the discharge valve assembly and the front squeeze trigger, the trigger being shown in the closed position in solid lines and in the open or discharge position in phantom lines, while the discharge valve assembly is illustrated in only the discharge position.

In one embodiment, as best illustrated in FIGS. 2 and 4, the trigger portion 22 includes a gripping portion 26 having the aforementioned finger gripping formation 24, and a transversely extending lever portion 28, which extends rearward from the top of the gripping portion 26 toward the rear portion 20 of the housing 16. The trigger portion 22 is pivotable about a pair of pivot pins 30 which extend outwardly from the lever arm 28 into openings 32 formed in the housing rear portion 20.

The assembly 14 can be fitted with one of a plurality of different discharge nozzles 34 positioned thereon. The discharge nozzle 34 may be adapted for use with specific types of fire extinguishers, specific types of extinguishing media and different size extinguisher bottles.

FIG. 4 illustrates the internal components and operation of the assembly 14. The housing 16 defines a flow chamber 36 which is in fluid flow communication with the extinguisher bottle 12. The chamber 36 provides flow communication for the extinguishing medium between the bottle 12 and the discharge nozzle 34. The flow chamber 36 includes a shoulder region or valve seat 38 intermediate the connection to the bottle 12 and the discharge nozzle 34.

A discharge valve assembly, such as the illustrated spring biased discharge valve assembly 40, is positioned within the flow chamber 36 and is configured to initiate and terminate the flow of the extinguishing medium. The discharge valve assembly 40 includes a seal 42, such as an o-ring, which is adapted to engage the valve seat, in direct action and in positive response to pressure acting thereon from the extinguishing medium inside the bottle 12 to terminate flow.

Conversely, as illustrated in FIG. 4 in solid lines, when the trigger handle 22 is squeezed or pulled inward, toward the housing 16, the lever arm 28 arcs in a downward motion as illustrated at 43. The lever arm 28 engages the discharge valve 40, which, in turn, is moved downward relative to the assembly 14, toward the bottle 12.

The downward movement of the discharge valve assembly 40 moves the seal 42 off of the valve seat 38, and establishes a flow path, illustrated at 44, initiating the flow of extinguishing medium from the bottle 12 to the nozzle 34.

When the gripping portion 26 is released, as illustrated in phantom lines in FIG. 4, a biasing element 48, such as the illustrated coil spring, forces the discharge valve assembly 40 upward (not shown). As a result, the seal 42 is reseated on the valve seat 38 thus stopping the flow of extinguishing medium.

The discharge valve assembly 40 is retained in place in the flow chamber 36 by a retaining member 46 which may be press-fitted or otherwise fitted in, or connected to, the chamber 36. The spring 48 is positioned between the discharge valve assembly 40 and the retaining member 46 to permit biased movement of the discharge valve assembly 40 and to bias the valve assembly 40 into the closed position. The discharge valve assembly 40 further includes a top end seal 50, such as an o-ring, to seal the top portion of the discharge valve assembly 40 where the assembly 40 is engaged by the lever arm 28.

The assembly 14 may also include a pressure indicator, such as the exemplary dial-type pressure gauge 52 to provide visible indication of the pressure in the extinguisher. Other types and methods of pressure indication will be readily recognized by those skilled in the art, which other types and methods of pressure indication are within the scope of the present invention. Optionally, the extinguisher 10 may also include a safety release pin 54, which pin 54 may be positioned in the housing 16, configured to interfere with movement of the trigger portion 22 into the discharge position until the pin 54 is removed therefrom.

Figure 5:
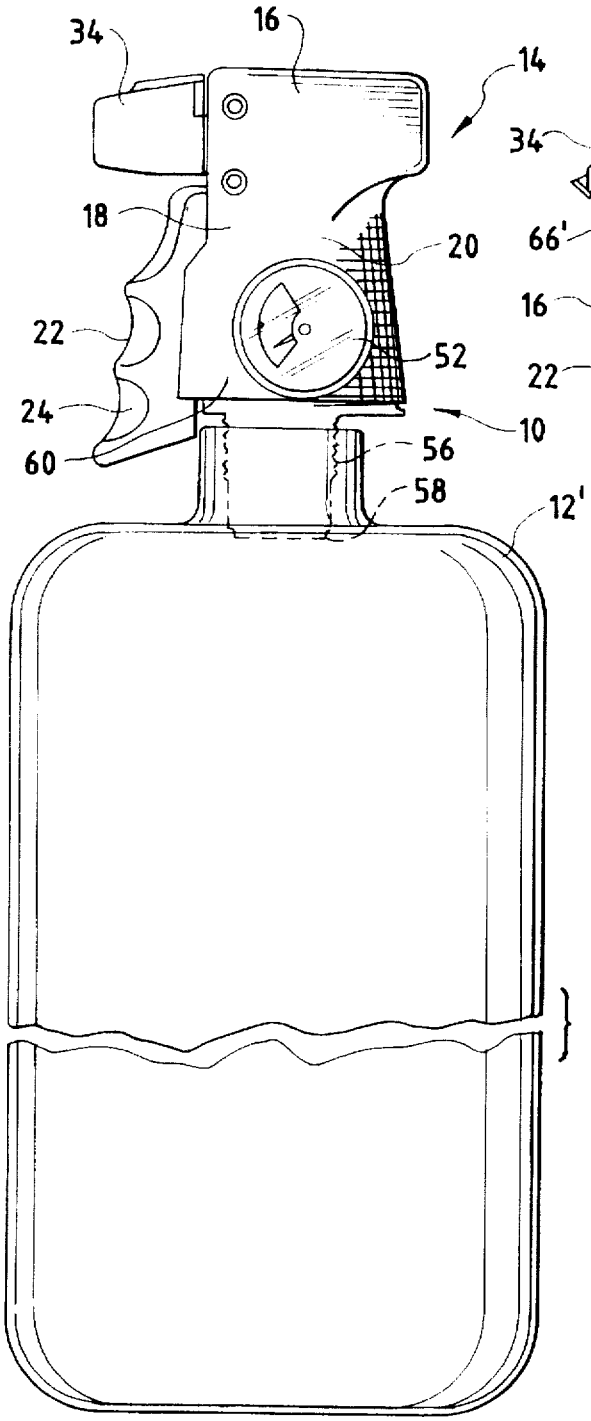
FIG. 5 is a side view of the assembly mounted to a relatively large extinguisher bottle.
Figure 6:
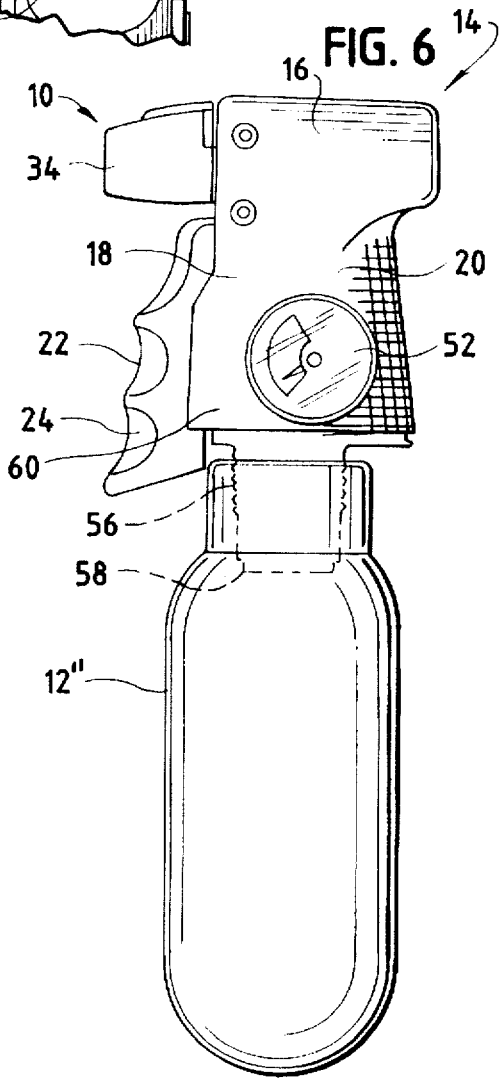
FIG. 6 is a view similar to FIG. 5, illustrating the assembly to a relatively small extinguisher bottle.

The assembly 14 includes a threaded neck portion 56 disposed on an exterior surface 58 of the housing 16 for threadedly engaging the extinguisher bottle 12. The threaded neck portion 56 is preferably configured to permit use of the assembly 14 with a variety of extinguisher bottles 12', 12" of different sizes, as illustrated in FIGS. 5 and 6. Thus, the assembly 14 provides an added benefit in that it is usable with different types and sizes of extinguishers.

The assembly 14 may also include a shroud portion 60 which extends downwardly, forming a part of the housing 16. The shroud 60 protects the flow chamber 36 and the discharge valve assembly 40, and reduces the opportunity for damage thereto due to inadvertently striking or bumping of the extinguisher 10.

The trigger portion 22 has an opening 62 therein. A nozzle stem 64 extends at least in part through the opening 62.

Figure 7:
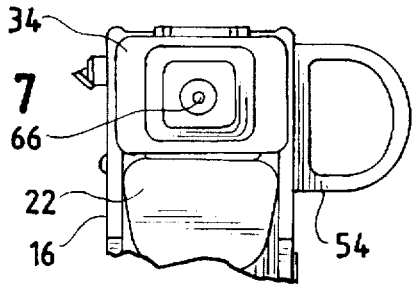
FIG. 7 is a partial front view of the assembly illustrating a discharge nozzle having a particular discharge port size.
Figure 8:
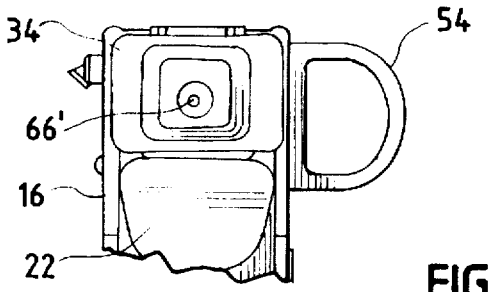
FIG. 8 is a view similar to FIG. 7 illustrating a discharge nozzle having a different discharge port size.

The stem 64 extends generally transversely to the flow chamber 36 and is in flow communication therewith. The stem 64 can be fitted with one of a plurality of different discharge nozzles 34. As best seen in FIGS. 7 and 8, the discharge nozzles 34 may have different sizes of openings or discharge ports 66, 66'. The different sizes of openings 66, 66' permit use of the assembly 14 with different types of extinguishing media, at differing flow rates, and at a variety of pressures. The different discharge port sizes 66, 66' provide differing spray characteristics of the flow stream of the extinguishing medium.

Figure 3:
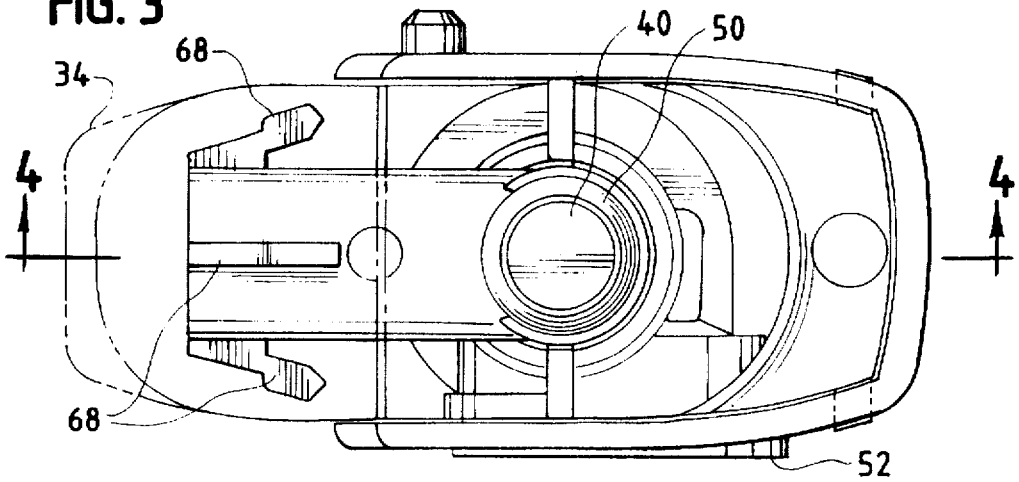
FIG. 3 is a top plan view, shown partially broken away, of the valve assembly of FIG. 1.

As best seen in FIGS. 2 and 3, the nozzle stem 64 may include a plurality of locking members 68 positioned around the stem 64. The members 68 engage locking receiving elements 70 formed in the nozzle 34, such that once the nozzle 34 is slid onto the stem 64, the nozzle 34 cannot be removed in normal use. In addition to the locking feature of the locking members 68 and receiving elements 70, the members 68 and elements 70 also provide for positive alignment of the nozzle stem 64 with the nozzle 34, to assure proper operation of the extinguisher 10.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A front squeeze trigger discharge assembly for use with an associated pressurized container having a pressurized medium therein, the discharge assembly comprising:

a housing having a first portion and a second portion, said housing defining a flow chamber at least partially aligned along a vertical axis and being mountable to the container, said second portion configured to rest in the hand of a user on a first side of said vertical axis;

a pivotable trigger handle mounted to said housing and having a gripping portion positioned at said first portion thereof, on a second side of the axis, diametrically opposite said first side of the axis, said handle also including a transverse lever having at least one pivot on said first side of the axis for rotatably supporting said handle relative to said housing, wherein said handle is rotatable between a first, closed position and a second, open position inward of said housing;

a discharge nozzle positioned on said first portion of said housing adjacent to said trigger handle on said second side of the axis, and in flow communication with said chamber, wherein said transverse lever is movable independently of said discharge nozzle; and a discharge valve assembly operably connected to said trigger handle and disposed along the axis in said chamber, said valve assembly being movable between a closed position downwardly to an open position, said open position providing a flow path between the container and said discharge nozzle, said transverse lever overlying said valve assembly, wherein said trigger handle is biased into said first, closed position, and pivotable from said first position to said second, open position by moving said trigger handle toward said second position of said housing, thereby moving said transverse lever against said discharge valve assembly to move to said open position to discharge the medium from the container through said discharge nozzle.

2. The front squeeze trigger discharge assembly of claim 1 wherein said housing includes a nozzle stem adapted to interchangeably receive one of a plurality of different discharge nozzles, said nozzle stem extending from and being in flow communication with said flow chamber.

3. The front squeeze trigger discharge assembly of claim 1 further including a safety release pin positionable in said housing, said safety release pin being adapted to interfere with moving said trigger handle from said first position to said second position when said safety pin is positioned in said housing.

4. The front squeeze trigger discharge assembly of claim 1 wherein said housing includes a threaded neck portion for threadedly engaging the container.

5. The front squeeze trigger discharge assembly of claim 1 wherein said housing includes a shroud adapted to cover at least a portion of said flow chamber and said valve assembly.

6. The front squeeze trigger discharge assembly of claim 2 wherein said nozzle stem includes a plurality of locking members for engaging said discharge nozzle.

7. The front squeeze trigger discharge assembly of claim 6 wherein said locking members are adapted to engage said discharge nozzle to align said discharge nozzle with said nozzle stem.

8. The front squeeze trigger discharge assembly of claim 6 wherein said discharge nozzle includes a plurality of locking receiving elements adapted to receive said locking members.

9. A front squeeze trigger discharge assembly for use with an associated pressurized container having a pressurized medium therein, the discharge assembly comprising:

a housing having a first portion and a second portion, the second portion configured to rest in the hand of a user, said housing defining a flow chamber having a vertical flow axis substantially located between said first and second portions and said housing being mountable to the container;

a pivotable trigger handle mounted to said housing and positioned for gripping at said first portion thereof, said handle including at least one pivot for rotatably supporting said handle relative to said housing, wherein said handle is rotatable between a first, closed position and a second, open position inward of said housing;

a discharge nozzle positioned on said first portion of said housing adjacent to said trigger handle and in flow communication with said pivotable trigger handle pivotable independently of said discharge nozzle wherein said pivotable trigger handle is pivotable independently of said discharge nozzle; and a discharge valve assembly operably connected to said trigger handle and disposed in said chamber, said valve assembly being movable between a closed position and an open position, said open position providing a flow path between the container and said discharge nozzle, wherein said trigger handle is biased into said first, closed position, and pivotable from said first position to said second, open position by moving said trigger handle toward said second position of said housing, thereby moving said discharge valve assembly to said open position to discharge the medium from the container through said discharge nozzle;

wherein said trigger handle includes a gripping portion and a lever arm generally transverse thereto, said gripping portion being mounted to said housing at about said first portion thereof, said lever arm extending from said gripping portion to said second portion of said housing across said vertical flow axis, said lever arm having said at least one pivot positioned thereon, engagable with said second portion, and being configured to coact with said discharge valve assembly to move said discharge valve assembly from said closed position to said open position when said handle is pivoted from said first position to said second position.

10. The front squeeze trigger discharge assembly of claim 9 wherein said gripping portion defines an opening therein configured to receive at least a portion of said valve stem extending therethrough.

11. The front squeeze trigger discharge assembly of claim 1 further including an indicator for indicating pressure within the container.

12. A pressurized fire extinguisher having a front squeeze trigger discharge assembly comprising:

a fire extinguisher container; and a fire extinguisher handle having a housing with a vertical axis and defining a flow chamber therein at least partially aligned with said vertical axis for providing flow communication between said container and a discharge nozzle mounted to said housing, said housing being configured to rest in a user's hand on a first side of said axis of said housing, and including a rotatable trigger having a transverse lever pivotably mounted thereto on said first side of said axis, and a gripping portion connected to said transverse lever and located adjacent to said discharge nozzle on a second side of said axis of said housing, allowing the user to grip the trigger and housing in one hand concentrically about said axis, the housing including a discharge valve assembly positioned in said flow chamber for opening movement along said vertical axis and being operably connected to said transverse lever and movable between a first, closed position and a second, discharge position when said trigger is moved toward said housing, wherein said transverse lever is pivotally movable independently of said discharge nozzle.

13. The pressurized fire extinguisher of claim 12 wherein said housing includes a nozzle stem in flow communication with said flow chamber and wherein said discharge nozzle is positioned on said stem.

14. The pressurized fire extinguisher of claim 13 wherein said stem is adapted to receive one of a plurality of different discharge nozzles, wherein said nozzles each include a discharge port and wherein some of said discharge ports are of a different size than others.

15. A squeeze trigger discharge assembly for use with one of a plurality of pressurized containers, the containers having a pressurized medium stored therein, the containers having necks opening the containers for discharge of the medium therefrom, the assembly comprising:

a housing defining a flow chamber and being mountable to one of the containers, the housing having a threaded neck portion for flow connection to the neck of said one of the containers, said threaded neck portion having an axis;

a pivotable trigger handle mounted to said housing and having a gripping portion located on a first side of said axis, and wherein said handle is pivotably movable toward said housing about a pivot on a second, opposite side of said axis between a first, non-discharge position and a second position wherein the pressurized medium is discharged from the container;

a discharge valve assembly positioned in said flow chamber operably connected to said pivotable trigger handle and being movable between a third position and a fourth position in conjunction with movement of said trigger handle, wherein said pressurized medium is discharged from the container;

a discharge nozzle mountable to said housing adjacent to said trigger handle on said first side of said axis, and being in flow communication with said flow chamber, said discharge nozzle having a discharge port configured for use with the pressurized media stored in the pressurized container.

16. The squeeze trigger discharge assembly of claim 15 further including a nozzle stem extending from said housing adapted to interchangeably receive one of a plurality of different discharge nozzles, and being in flow communication with said flow chamber.

17. The squeeze trigger discharge assembly of claim 16 wherein said nozzle stem extends generally transversely from said flow chamber.

18. The squeeze trigger discharge assembly of claim 17 wherein said nozzle stem includes a plurality of locking members for engaging said discharge nozzle.

19. The squeeze trigger discharge assembly of claim 18 wherein said locking members are adapted to engage said discharge nozzle to align said discharge nozzle with said nozzle stem.

20. The front squeeze trigger discharge assembly of claim 19 wherein said discharge nozzle includes a plurality of locking receiving elements adapted to receive said locking members.

21. The front squeeze trigger discharge assembly of claim 15 wherein said stem is adapted to receive one of a plurality of discharge nozzles, wherein said nozzles each include a discharge port and wherein some of said discharge ports are of a different size than others.

22. The pressurized fire extinguisher of claim 12 wherein said rotatable trigger is positioned below said discharge nozzle.

23. The pressurized fire extinguisher of claim 22 comprising a lever arm connected to said rotatable trigger, said lever arm crossing said axis of said housing, and being pivotally connected to said housing on said first side of said axis of said housing, said discharge valve assembly engaged by said lever arm to be moved downwardly by pivoting movement of said lever arm when said trigger i s moved toward said housing.

24. The front squeeze trigger discharge assembly of claim 1 wherein said pivotable trigger handle is positioned below said discharge nozzle.

25. The front squeeze trigger discharge assembly of claim 24, comprising a lever arm connected to said pivotable trigger handle, said lever arm crossing said axis, and being pivotally connected to said housing on said first side of said axis, said discharge valve assembly engaged by said lever arm to be moved downwardly from said first position to said second open position by pivoting movement of said lever arm when said trigger handle is moved toward said housing.

26. The squeeze trigger discharge assembly of claim 15 wherein said pivotable trigger handle is positioned below said discharge nozzle.

27. The squeeze trigger discharge assembly of claim 26, comprising a lever arm connected to said pivotable trigger handle, said lever arm crossing said axis, and being pivotally connected to said housing on said second side of said axis, said discharge valve assembly engaged by said lever arm to be moved downwardly from said first position to said second open position by pivoting movement of said lever arm when said trigger handle is moved toward said housing.

* * * * *

UNITED STATES PATENT AND TRADEMARK OFFICE

CERTIFICATE OF CORRECTION

PATENT NO. : 5,775,432

DATED : July 7, 1998

INVENTOR(S) : Clay Burns, Victor Cheung, Paul Sabin, Susannah Gardner

It is certified that error appears in the above-identified patent and that said Letters Patent is hereby corrected as shown below:

At col. 6, line 22-23, please replace "said pivotable trigger handle pivotable independently of said discharge nozzle" with --said chamber--.

Signed and Sealed this

Fifth Day of October, 1999

*Attest:*

*Attesting Officer*

Q. TODD DICKINSON

*Acting Commissioner of Patents and Trademarks*